US007353866B2

(12) United States Patent
Snider et al.

(10) Patent No.: US 7,353,866 B2
(45) Date of Patent: Apr. 8, 2008

(54) STIMULATION TOOL HAVING A SEALED IGNITION SYSTEM

(75) Inventors: Philip M. Snider, Houston, TX (US); David S. Wesson, Fort Worth, TX (US); Kevin R. George, Cleburne, TX (US); Joseph P. Haney, Dalton Gardens, ID (US)

(73) Assignee: Marathon Oil Company, Houston, TX (US)

( * ) Notice: Subject to any disclaimer, the term of this patent is extended or adjusted under 35 U.S.C. 154(b) by 365 days.

(21) Appl. No.: 11/114,244

(22) Filed: Apr. 25, 2005

(65) Prior Publication Data

US 2006/0237190 A1 Oct. 26, 2006

(51) Int. Cl.
*E21B 43/11* (2006.01)

(52) U.S. Cl. ..... 166/55.2; 166/297

(58) Field of Classification Search ..... 166/262, 166/55, 55.2, 63, 297
See application file for complete search history.

(56) References Cited

U.S. PATENT DOCUMENTS 5,005,641 A * 4/1991 Mohaupt ..... 166/63
5,390,742 A * 2/1995 Dines et al. ..... 166/297
6,082,450 A 7/2000 Snider et al.
6,263,283 B1 * 7/2001 Snider et al. ..... 702/6
6,494,261 B1 12/2002 Pahmiyer
2002/0033264 A1 * 3/2002 Parrott et al. ..... 166/297
2002/0056553 A1 * 5/2002 Duhon et al. ..... 166/302
2006/0048940 A1 * 3/2006 Hromas et al. ..... 166/297
2006/0185898 A1 8/2006 Seekford

OTHER PUBLICATIONS

U.S. Appl. No. 60/655,456, filed Feb. 23, 2005, Seekford.

* cited by examiner

*Primary Examiner*—Jennifer H Gay
*Assistant Examiner*—Daniel P Stephenson
(74) *Attorney, Agent, or Firm*—Jack E. Ebel; Rodney F. Brown

(57) ABSTRACT

An apparatus for stimulating a subterranean formation includes a first tube, a second tube, a combustion body and an ignition propagator. The second tube is positioned within the first tube interior and the second tube interior is sealed from the first tube interior to substantially prevent fluid communication between the first tube interior and the second tube interior. The combustion body is formed from a solid propellant and is positioned within the first tube interior external to the second tube interior. The ignition propagator is positioned within the second tube interior and is substantially free from fluid contact with fluid residing in the surrounding environment external to the first tube wall.

34 Claims, 5 Drawing Sheets

STIMULATION TOOL HAVING A SEALED IGNITION SYSTEM

TECHNICAL FIELD

The present invention relates to a method and tool for stimulating a subterranean formation penetrated by a well bore, and more particularly, to a tool employing a combustion body and ignition system and to a method for using the tool to stimulate the subterranean formation and enhance the effectiveness of perforations which provide fluid communication between the well bore and the formation.

BACKGROUND OF THE INVENTION

The integrity of a well bore penetrating a subterranean formation is enhanced by joining individual lengths of relatively large diameter metal tubulars together, which are termed casing, to form a casing string, which is positioned in the well bore. The casing string is commonly cemented to the well bore face and subsequently perforated at the production interval of the well bore by detonating shaped explosive charges therein. The resulting perforations extend through the casing and cement a short distance into the formation. In addition to increasing the integrity of the well bore, the perforated casing string provides a conduit for producing fluids through the well bore to the surface.

In certain instances it is desirable to conduct perforating operations while maintaining the well bore pressure in an overbalanced condition with respect to the formation pressure. The overbalanced well bore pressure typically exceeds the formation fracturing pressure which induces hydraulic fracturing in the vicinity of the perforations. Such deliberate inducement of fractures in the formation at the perforations is generally termed stimulation. While the perforations often extend only a matter of inches into the formation, a fracture network may extend several feet into the formation. The fracture network provides an enlarged conduit for producing fluids from the formation into the well bore and may significantly increase well productivity.

Gas generating propellants have been utilized in lieu of hydraulic fracturing as an alternate stimulation technique for creating and propagating fractures in a subterranean formation. In accordance with conventional propellant stimulation techniques, a propellant is ignited locally to generate a gas which pressurizes the production interval of the well bore either in association with the perforating step or after the perforating step. The resulting gas creates and propagates fractures in the formation at the production interval of the well bore.

A conventional propellant stimulation tool consists of a propellant body cast from a solid rocket propellant material and an ignition system which includes a starter assembly and an ignition propagator connected to the starter assembly. The starter assembly typically includes a detonator and the ignition propagator is typically a detonator cord. The ignition propagator can optionally include a thin walled aluminum or cardboard sleeve around the detonator cord, which facilitates placement of the detonator cord within the tool.

It has been found that the intrusion of well bore fluids into the ignition system, for example, into the connection between the starter assembly and ignition propagator, can diminish the functionality of the ignition system. Even if a sleeve is provided for the detonator cord, the sleeve is open ended and lacks sufficient structural integrity to effectively seal the ignition system against fluid intrusion therein from the surrounding environment. A common technique for reducing contact between the ignition system and well bore fluids is to wrap the connection between the starter assembly and ignition propagator in a fluid resistant tape.

In any case, the above-described propellant stimulation tool is not universally suited for use in all types of well bores because the tool lacks sufficient mechanical strength to withstand excessive forces encountered in many types of well bores. For example, the present propellant stimulation tool is generally unsuitable for use in small diameter well bores, well bores which are deviated, and/or well bores where the temperature exceeds about 275° F. due to excessive forces therein.

The structural integrity of the above-described propellant stimulation tool can be increased by inserting the propellant body into a reusable metal carrier, which supports the propellant body during placement in the well bore and subsequent ignition of the propellant. Alternatively, the size of the propellant body can be expanded and fitted around a reusable metal carrier which supports the propellant body. U.S. Pat. No. 6,082,450, which is incorporated herein by reference, discloses such a propellant stimulation tool wherein a reusable metal carrier internal to a propellant body supports the propellant body. The propellant stimulation tool of U.S. Pat. No. 6,082,450 advantageously has utility in well bores of varying diameters and orientations. The supported propellant stimulation tool generally provides a repeatable and reliable propellant burn in a discrete or controlled pattern upon ignition of the propellant.

Despite its advantageous performance features, propellant stimulation tool of U.S. Pat. No. 6,082,450, does not fully seal the interior of the tool to well bore fluids. The tool permits the flow or seepage of well bore fluids into the interior of the tool where the fluids can contact the ignition system. Like other prior art tools, a tape wrapping is relied upon to minimize contact between the ignition system and the well bore fluids. Unfortunately, the tape wrapping does not always adequately isolate the ignition system from the well bore fluids. When the tape wrapping fails to satisfactorily protect the ignition system from the well bore fluids, the ability of the detonator cord to properly propagate detonation of the propellant is compromised, which diminishes the repeatability and reliability of the propellant burn and correspondingly diminishes the overall performance of the propellant stimulation tool. As such, a propellant stimulation tool is needed which maintains the ignition system sufficiently dry across a broad range of well bore conditions.

Thus, it is an object of the present invention to provide a stimulation tool for a subterranean formation utilizing a combustion material, such as a propellant, ignited by an ignition system, wherein the tool maintains the ignition system in essential fluid isolation from well bore fluids. It is another object of the present invention to provide a stimulation tool for a subterranean formation utilizing a combustion material ignited by an ignition system, wherein the combustion material is in the form of a solid combustion body maintained on a mounting frame, which also supports an ignition propagator, within the tool. It is still another object of the present invention to provide such a stimulation tool, wherein ignition of a combustion material is carefully controlled by appropriately specifying certain physical parameters of the tool to achieve a substantially reliable and repeatable burn of the combustion material.

These objects and others are accomplished in accordance with the invention described hereafter.

SUMMARY OF THE INVENTION

The present invention is an apparatus for stimulating a subterranean formation. The apparatus comprises a first tube, a second tube, a combustion body and an ignition propagator. The first tube has a first tube interior and a first tube wall with a length. A preferred first tube further has open first and second ends. The first tube wall has at least one aperture along the length of the first tube wall. A preferred aperture is an open aperture permitting fluid communication between the first tube interior and a surrounding environment external to the first tube wall. A preferred first tube is fabricated from a material and in a configuration such that the first tube does not substantially decompose or disintegrate during ignition or burning of the combustion body.

The second tube is positioned within the first tube interior and has a second tube interior, a second tube wall with a length, a first open end, and a second open end. The second tube interior is sealed from the first tube interior to substantially prevent fluid communication between the first tube interior and the second tube interior. A preferred second tube is fabricated from a material and in a configuration such that the second tube substantially decomposes or disintegrates upon ignition of the ignition propagator.

The combustion body is preferably a combustible material selected from a group consisting of propellants, explosives and shaped charges which is configured in a solid form. The combustion body is positioned within the first tube interior external to the second tube interior. The ignition propagator preferably includes a detonator cord, which is positioned within the second tube interior. The ignition propagator is substantially free from fluid contact with fluid residing in a surrounding environment external to the first tube wall.

A preferred apparatus further comprises a first connector member, a second connector member, a first sealing assembly, and a second sealing assembly. The first connector member is connected to the first end of the first tube and has a first connector interior. The second connector member is connected to the second end of the first tube and has a second connector interior such that the first tube is serially positioned between the first and second connector members. The first sealing assembly engages the second tube to substantially prevent fluid communication between the first tube interior and the first connector interior. The second sealing assembly engages the second tube to substantially prevent fluid communication between the first tube interior and the second connector interior. A preferred ignition propagator extends from the first tube interior into the first and second connector interiors and similarly extends from the second tube interior into the first and second connector interiors.

The preferred apparatus still further comprises a third connector member having a third connector interior. The third connector member connects the second connector member to the second end of the first tube and is serially positioned between the first tube and the second connector member. The second tube is positioned in the third connector interior.

An alternate preferred apparatus comprises a first connector member, a second connector member, a third connector member and a fourth connector member. The first and second connector members are connected to the first end of the first tube and the second connector member is serially positioned between the first tube and the first connector member. The third and fourth connector members are connected to the second end of the first tube and the third connector member is serially positioned between the first tube and the fourth connector member. The first, second, third and fourth connector members have first, second, third and fourth connector interiors, respectively.

The alternate preferred apparatus further comprises a first sealing assembly engaging the second tube to substantially prevent fluid communication between the first tube interior and the first connector interior and a second sealing assembly engaging the second tube to substantially prevent fluid communication between the first tube interior and the fourth connector interior. A preferred ignition propagator extends from the first tube interior into the first, second, third and fourth connector interiors and similarly extends from the second tube interior into the first and fourth connector interiors.

In another characterization of the invention, the apparatus comprises a first tube, a second tube, a first combustion body and an ignition propagator. The first tube has a first tube interior and a first tube wall. The first tube wall has an inner face, an outer face, a length, and at least one aperture along the length of the first tube wall. The second tube is positioned within the first tube interior and has a second tube interior and a second tube wall. The second tube wall has an inner face, an outer face and a length. The outer face of the second tube wall and the inner face of the first tube wall define an annular volume. A preferred second tube interior is sealed from the first tube interior to substantially prevent fluid communication between the first tube interior and the second tube interior. A preferred ignition propagator includes a detonator cord positioned within the second tube interior substantially free from fluid contact with fluid residing in a surrounding environment external to the first tube wall.

The first combustion body is preferably a first propellant member formed from a solid propellant which has a longitudinal opening and a member wall. The member wall has an inner face, an outer face and a length. The first combustion body is positioned in the first tube interior and the longitudinal opening of the first combustion body receives the second tube, preferably slidably receiving the second tube. The first combustion body does not substantially extend beyond the annular volume. The length of the member wall of a preferred first combustion body is substantially less than the length of the second tube wall. The ignition propagator is positioned within the second tube interior.

A preferred apparatus further comprises a void between the outer face of the member wall of the first combustion body and the inner face of the first tube wall. The preferred apparatus still further comprises a second combustion body having a longitudinal opening and a member wall. The member wall of the second combustion body has an inner face, an outer face and a length. The length of the member wall of a preferred second combustion body is substantially equal to the length of the member wall of the first combustion body. The second combustion body is positioned in the first tube interior and the longitudinal opening of the second combustion body receives the second tube, preferably slidably receiving the second tube, such that the second combustion body is mounted on the second tube substantially adjacent the first combustion body.

The preferred apparatus further comprises a void between the outer face of the member wall of the second combustion body and the inner face of the first tube wall. The preferred apparatus still further comprises a third combustion body having a longitudinal opening and a member wall. The member wall of the third combustion body has an inner face, an outer face and a length. The third combustion body is positioned in the first tube interior and the longitudinal opening of the third combustion body receives the second tube such that the third combustion body is mounted on the second tube substantially adjacent the first or second combustion body.

Another characterization of the invention is a method for stimulating a subterranean formation penetrated by a well bore in fluid communication with the formation. The method comprises positioning a stimulation apparatus within the well bore in proximity to the subterranean formation. The stimulation apparatus comprises a first tube, a second tube, a combustion body and an ignition propagator. The first tube has a first tube interior, a first tube wall with a length, and at least one aperture along the length of the first tube wall. The second tube is positioned within the first tube interior. The second tube has a second tube interior and a second tube wall with a length. The combustion body is positioned within the first tube interior external to the second tube interior. The ignition propagator is positioned within the second tube interior.

The method further comprises igniting the combustion body by the ignition propagator and burning the ignited combustion body at a controlled burn rate. The burning combustion body forms a combustion gas which extends fluid communication between the formation and the well bore. The controlled burn rate is determined by fixing a value of one or more parameters of the stimulation apparatus selected from a group consisting of relative geometry of the second tube and the combustion body, density of the ignition propagator, explosive load of the ignition propagator, material composition of the second tube and thickness of the second tube wall, and diameter of the second tube interior.

Another characterization of the invention is a method for defining the operational performance of a stimulation apparatus. The method comprises selecting a first value of one or more parameters of a stimulation apparatus. The stimulation apparatus comprises a first tube, a second tube, a combustion body and an ignition propagator. The first tube has a first tube interior, a first tube wall with a length, and at least one aperture along the length of the first tube wall. The second tube is positioned within the first tube interior. The second tube has a second tube interior and a second tube wall with a length. The combustion body is positioned within the first tube interior external to the second tube interior. The ignition propagator is positioned within the second tube interior. The one or more parameters are selected from a group consisting of relative geometry of the second tube and the combustion body, thickness of the ignition propagator, density of the ignition propagator, explosive load of the ignition propagator, material composition of the second tube and thickness of the second tube wall, diameter of the second tube interior, size of the apertures, number of the apertures, and pattern of the apertures along the length of the first tube wall.

The method further comprises positioning a plurality of process condition monitors in a well bore, positioning the stimulation apparatus within the well bore and performing a first test run of the stimulation apparatus. The first test run comprises igniting the combustion body with the ignition propagator and burning the ignited combustion body, thereby forming a combustion gas. First test run data relating to the combustion gas, preferably pressure data, are obtained using the process condition monitors. The first value of the one or more parameters is modified to a second value of the one or more parameters in response to the first test run data. A second test run, which is substantially the same as the first test run, is performed and second test run data relating to the combustion gas is obtained using the process condition monitors. A preferred method further comprises fixing the second value of the one or more parameters or modifying the second value of the one or more parameters to a third value of the one or more parameters in response to the second test run data.

The present invention will be further understood from the drawings and the following detailed description.

DESCRIPTION OF THE PREFERRED EMBODIMENTS

Figure 1:
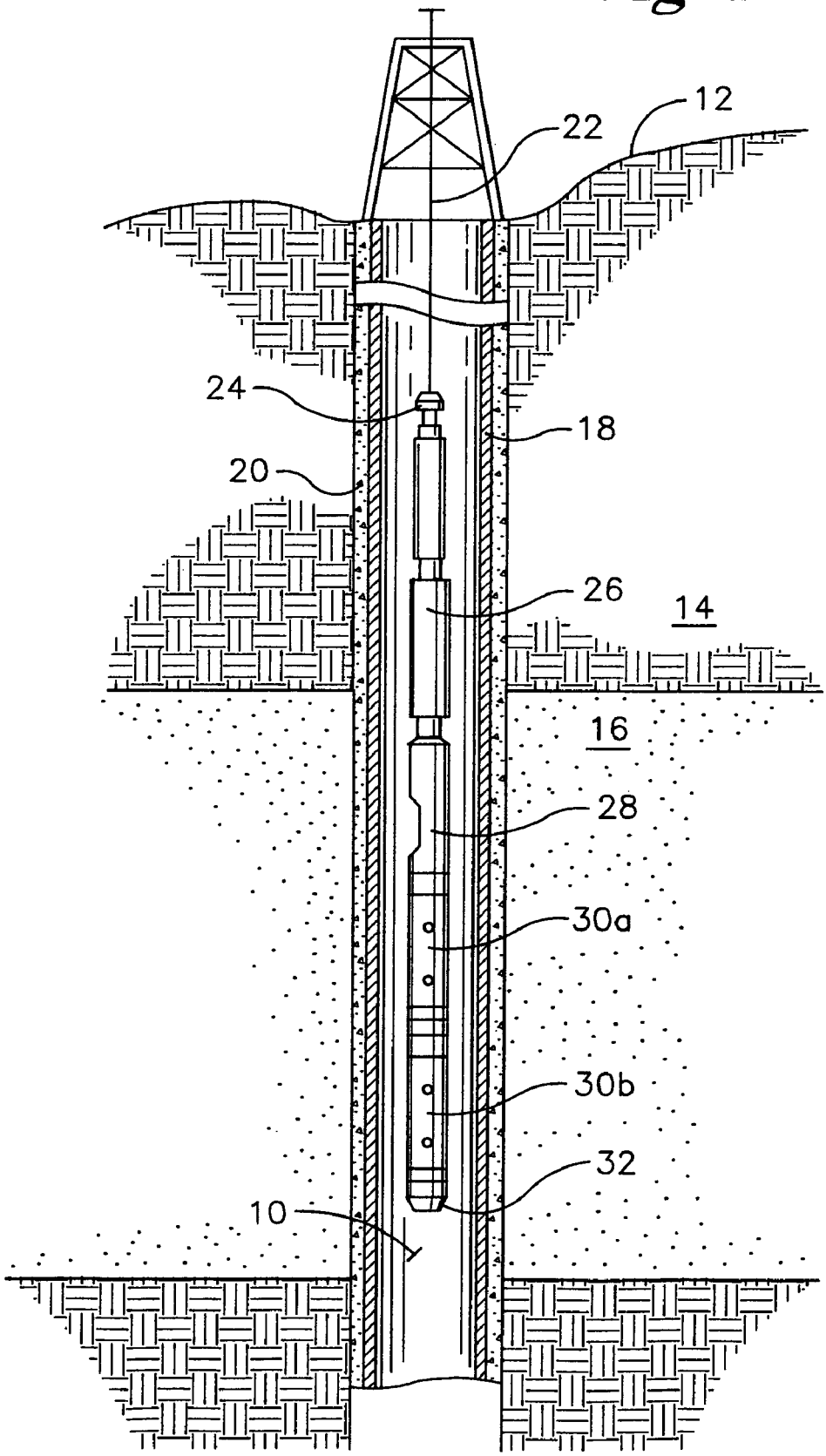
FIG. 1 is a conceptualized view of a stimulation tool of the present invention positioned within a well bore penetrating a subterranean formation.

Referring initially to FIG. 1, a well bore 10 extends from an earthen surface 12 through the earth 14 into a subterranean formation 16. For purposes of illustration, the well bore 10 is a substantially vertical well bore. However, the present invention has particular utility in well bores which deviate from vertical, including horizontal well bores and other well bores having a high deviation angle from vertical. The face of the well bore 10 has a casing 18 positioned along its length which is secured to the face by cement 20.

In accordance with the embodiment of FIG. 1, a wireline 22 is provided and a cable head 24 is secured to an end of the wireline 22. A logging tool 26, an adaptor sub 28, and a stimulation tool of the present invention are connected end to end in series with the cable head 24 by any suitable means, such as screw threads. An exemplary logging tool 26 is a collar log. For purposes of illustration, the stimulation tool of the present invention shown in FIG. 1 has two stimulation modules 30*a*, 30*b* connected end to end in series. However, this illustration is not to be construed as limiting the scope of the invention. The stimulation tool of the present invention encompasses substantially any stimulation tool having at least one stimulation module 30*a*, and optionally having any number of additional stimulation modules 30*b*, 30*c*, 30*d*, etc. (not shown), which are connected end to end in series with the first stimulation module 30*a*. In the present embodiment, the stimulation tool further comprises a fluid-tight cap 32, which is connected to the final stimulation module 30*b* of the series 30*a*, 30*b* by any suitable means, such as screw threads, and which terminates the stimulation tool. Alternatively, the terminus of the stimulation tool may be the final stimulation module 30*b* of the series, which is connected in a fluid-tight manner with another down hole tool or other down hole device (not shown).

In any case, the wireline 22, having the cable head 24, logging tool 26, adaptor sub 28 and stimulation tool serially connected thereto, is lowered into the well bore 10 until the stimulation tool is at the depth of the subterranean formation 16. Any suitable means, such as a packer and tubing (not shown), may be employed to isolate the portions of the well bore 10 above and below the stimulation tool from one another if desired. In accordance with alternate embodiments not shown, it is within the purview of the skilled artisan to alternatively position and support the stimulation tool within the well bore 10 by means of a slick line, coil tubing, tubing string or any other suitable means. The alternate support means and stimulation tool are lowered into the well bore 10 until the stimulation tool is at the depth of the subterranean formation 16 in substantially the same manner as shown in FIG. 1. Well bore isolation can likewise be effected by any suitable means if desired.

Figure 2:
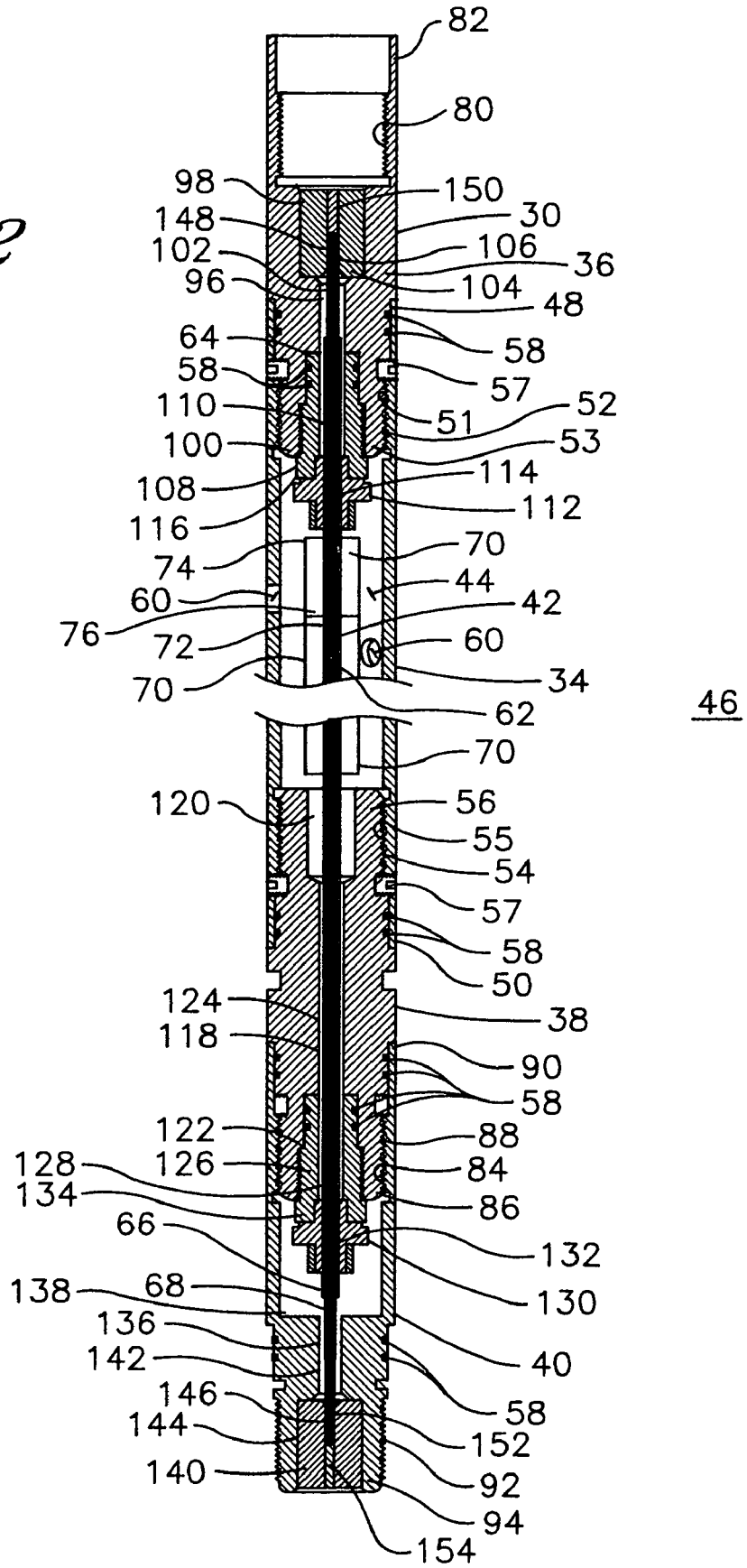
FIG. 2 is a longitudinal cross sectional view of a stimulation module having utility in the stimulation tool of FIG. 1.
Figure 3:
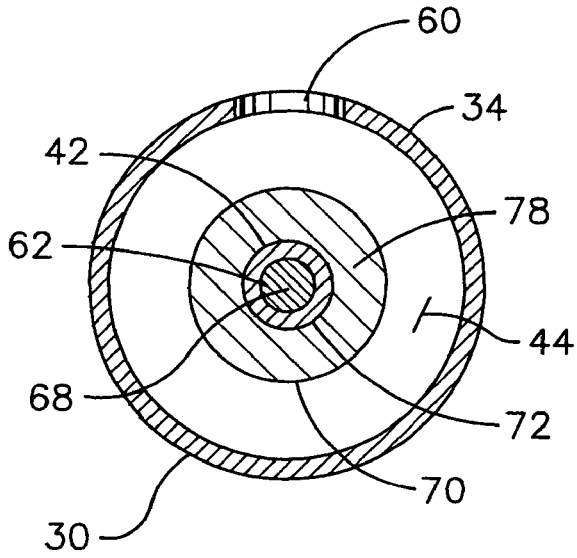
FIG. 3 is a transverse cross sectional view of the stimulation module of FIG. 2.

Referring to FIGS. 2 and 3, details of a stimulation module having utility in the stimulation tool of the present invention are shown and described hereafter. The stimulation module of FIGS. 2 and 3 is designated 30 and applies generally to the stimulation modules designated 30*a* and 30*b* in FIG. 1, insofar as the stimulation modules 30*a* and 30*b* are essentially identical to one another and to the stimulation module 30 of FIGS. 2 and 3. The relative terms "upper" and "lower" are used in the following description to distinguish various elements of the stimulation module 30 from one another, but are not to be construed as limiting the scope of the invention. The terms "upper" and "lower" describe the relative position of a given element of the stimulation module 30 as being either above or below another element of the module 30 when the module 30 is lowered into the vertical well bore 10.

The stimulation module 30 comprises a carrier 34, an upper connector member 36, a first lower connector member 38, a second lower connector member 40 and an isolation member 42. The carrier 34 and isolation member 42 each preferably has a tubular configuration characterized as a hollow cylinder which is open at both ends. The isolation member 42 has a substantially smaller outside diameter than the inside diameter of the carrier 34. The isolation member 42 and carrier 34 are longitudinally aligned with one another and the isolation member is positioned within the carrier 34, preferably concentrically, to define a carrier annular volume 44 which extends from the inner face of the carrier 34 and the outer face of the isolation member 42. As such, the carrier 34 is a shell which separates the carrier annular volume 44 from the surrounding environment 46 external to the carrier 34. When the stimulation module 30 resides in the well bore 10 as shown in FIG. 1, the surrounding environment 46 is the well bore 10, which typically contains formation fluids.

The carrier 34 is preferably fabricated from a high-integrity metal, such as a high-grade steel, which is reusable, i.e., is resistant to substantial destruction or damage during normal operation of the stimulation tool. The upper and lower ends 48, 50 of the carrier 34 are both open and each is provided with suitable means of connection with the upper connector member 36 and the first lower connector member 38, respectively. In particular, the upper end 48 of the carrier 34 is provided with upper female screw threads 51 which cooperatively couple with male screw threads 52 on the lower end 53 of the upper connector member 36. The lower end 50 of the carrier 34 is provided with lower female screw threads 54 which cooperatively couple with upper male screw threads 55 on the upper end 56 of the first lower connector member 38. Set screws 57 are additionally provided to further secure the connection between the carrier 34 and the upper and first lower connector members 36, 38, respectively. O-rings 58 are positioned at the intersection of the carrier 34 and the upper and first lower connector members 36, 38, respectively, to provide a fluid-tight seal therebetween.

Although the carrier 34 is preferably substantially straight, having a substantially uniform round transverse cross section along its entire length, the carrier 34 may alternatively be uniformly tapered or otherwise expanded or constricted at one or more locations along its length or may have an alternate transverse cross sectional configuration such as a square or oval. Such alternate configurations of the carrier 34 may be selected in response to the characteristics of a given well bore and/or application as will be evident to the skilled artisan. In any case, the length of the carrier 34 is typically on the order of up to about 20 feet or more and the transverse cross sectional diameter of the carrier 34 is typically on the order of up to about 4 inches or more. Exemplary dimensions of the carrier 34 are a length of about 21 feet, an outside diameter of about 2.875 inches, an inside diameter of about 2.35 inches, and a wall thickness of 0.2625 inches.

The carrier 34 has one or more apertures 60 formed therein. In the case of multiple apertures 60, the apertures 60 may be either uniformly or randomly spaced along the carrier 34. The apertures 60 may extend along only a portion of the length of the carrier 34 or may extend along substantially the entire length of the carrier 34. Alternate embodiments of apertures are described hereafter, all of which have utility in the present invention. Although only a single aperture is described for each embodiment, it is understood that the description of single apertures applies to multiple apertures as well.

The term "aperture", as utilized herein, generally denotes either an "open aperture" or a "rupturable aperture". An open aperture 60 is preferred and shown in FIGS. 2 and 3. The open aperture 60 is defined herein as an opening, such as hole, port or the like, which extends completely through the wall thickness of the carrier 34 and enables fluid communication between the carrier annular volume 44 and the surrounding environment 46. The aperture 60 has a generally circular peripheral configuration for purposes of illustration. However, the aperture 60 can have substantially any other suitable peripheral configuration. For example, the aperture 60 can have the peripheral configuration of a star, cross, or the like, as is apparent to a skilled artisan.

A rupturable aperture (not shown) is defined herein as a relatively small section of the carrier 34 which, in association with the remainder of the carrier 34, initially continuously encloses the carrier annular volume 44 and provides the carrier annular volume 44 with fluid isolation from the surrounding environment 46. However, the rupturable aperture is ruptured upon ignition of a combustion body described hereafter to provide an opening extending completely through the wall thickness of the carrier 34 and enabling fluid communication between the carrier annular volume 44 and the surrounding environment 46.

A rupturable aperture and the remainder of the carrier 34 can be integrally fabricated from a common continuous material such as the above-recited high-grade steel. The thickness of the rupturable aperture is substantially reduced relative to the remainder of the carrier 34. As a result, the reduced thickness of the rupturable aperture is readily blown open upon ignition of a combustion body. However, the thickness of the remainder of the carrier 34 is sufficient to withstand the ignition force of the combustion body without opening. Alternatively, the rupturable aperture is initially fabricated as an opening through the carrier 34. However, a plug formed from the same or a different material than the carrier 34 is removably secured in the opening to selectively seal the opening. The plug is readily blown out of the opening upon ignition of the combustion body while the remainder of the carrier 34 withstands the ignition force of the combustion body without opening.

The isolation member 42 preferably fully encloses an isolation member interior 62 along the entire length of the isolation member 42, i.e, the entire length of the isolation member 42 is free of apertures. As such, the isolation member 42 prevents fluid communication between the carrier annular volume 44 and the interior 62 along the entire length of the isolation member 42. However, the isolation member 42 has upper and lower ends 64, 66 which are open.

The isolation member 42 is preferably constructed from a uniform material having a uniform wall thickness along it entire length. The material and wall thickness of the isolation member 42 are preferably selected such that the isolation member 42 has sufficient structural integrity to withstand the ambient pressure of the surrounding environment 46 without rupturing or otherwise allowing fluid communication between the carrier annular volume 44 and the interior 62. However, the material and wall thickness of the isolation member 42 are selected such that the isolation member 42 is readily ruptured or otherwise broken open or apart upon detonation of an ignition propagation propagator, such as an explosive, positioned within the interior 62. Thus, for example, the material of the isolation member 42 can be a frangible metal, plastic, or composite. A preferred isolation member 42 is fabricated from a type of tubing known in the art as "control line".

The isolation member 42 may be uniformly tapered or otherwise expanded or constricted at one or more locations along its length. However, the isolation member 42 is preferably substantially straight, having a substantially uniform transverse cross section along its entire length. The transverse cross sectional diameter of the isolation member 42 is preferably less than about 1 inch. Exemplary dimensions of the isolation member 42 are an outside diameter of about 0.375 inches, an inside diameter of about 0.277 inches, and a wall thickness of about 0.049 inches. The length of the isolation member 42 is preferably at least about equal to the length of the carrier 34 so that the isolation member 42 extends continuously from approximately the upper end 48 of the carrier 34 to approximately the lower end 50 of the carrier 34. The length of the isolation member 42 is more preferably substantially greater than the length of the carrier 34 so that the upper end 64 of the isolation member 42 extends substantially upwardly past the upper end 48 of the carrier 34 and/or the lower end 66 of the isolation member 42 extends substantially downwardly past the lower end 50 of the carrier 34.

An ignition propagator is positioned in the interior 62 of the isolation member 42. The ignition propagator is preferably a component(s) of an ignition system, examples of which are described in full hereafter. The ignition propagator preferably includes an explosive and continuously extends substantially the entire length of the interior 62. A preferred ignition propagator comprises a detonator cord segment 68, for example, a 40 grain detonator cord segment which includes an explosive. The detonator cord segment 68 is threaded into the open upper or lower end 64 or 66 of the isolation member 42 and extends from the upper end 64 to the lower end 66 substantially the entire length of the interior 62. The detonator cord segment 68 preferably has a cross sectional diameter about equal to or slightly less than the inside diameter of the isolation member 42 to enable close-fitting engagement of the detonator cord segment 68 with the inner face of the isolation member 42. Although the detonator cord segment 68 may be physically affixed to the inner face of the isolation member 42 by any suitable means, the detonator cord segment 68 is preferably suspended unsecured within the interior 62. Although not shown, the ignition propagator may alternatively comprise a deflagrating material or cord. For example, the ignition propagator may alternatively utilize black powder rather than a detonator cord to ignite a combustion body, described hereafter, within the stimulation module 30.

A combustion body is positioned in the carrier annular volume 44 between the inner face of the carrier 34 and the outer face of the isolation member 42. The combustion body is preferably a combustible material configured as a solid body. The combustible material is selected from a group consisting of propellants, explosives and shaped charges. The combustion body is preferably a solid propellant formed as one or more propellant members 70, each having the tubular configuration of an open-ended hollow cylinder. Each propellant member 70 has a longitudinal opening 72 preferably concentric with the central longitudinal axis of the propellant member 70 and extending the entire length of the axis. The propellant member 70 preferably fully encloses the longitudinal opening 72 along its entire length, but has upper and lower ends 74, 76 which are open. The isolation member 42 preferably acts as a mounting frame for the propellant member 70. In particular, the isolation member 42 extends the length of the longitudinal opening 72 and out the open upper and lower ends 74, 76 of the propellant member 70, thereby supporting the propellant member 70 while retaining the propellant member 70 in slidable circular engagement with the outer face of the isolation member 42.

It is apparent from the above that the propellant member 70 has an outside diameter no greater than the inside diameter of the carrier 34, but substantially greater than the outside diameter of the isolation member 42. If desired, the outside diameter of the propellant member 70 may be substantially less than the inside diameter of the carrier 34 so that a gap is maintained between the outer face of the propellant member 70 and the inner face of the carrier 34. The longitudinal opening 72 of the propellant member 70 has a cross sectional diameter about equal to or greater than the outside diameter of the isolation member 42 to enable slidable engagement of the inner face of the propellant member 70 with the outer face of the isolation member 42. The propellant member 70 is constructed so the diameter of the longitudinal opening 72 substantially approaches the outside diameter of the isolation member 42 if close fitting engagement of the propellant member 70 with the isolation member 42 is desired by the practitioner. Alternatively, the propellant member 70 is constructed so the diameter of the longitudinal opening 72 substantially diverges from the outside diameter of the isolation member 42 if loose fitting engagement of the propellant member 70 with the isolation member 42 is desired by the practitioner.

The amount of propellant in the propellant member 70 is a function of the length of the propellant member 70, the diameter of the longitudinal opening 72 and the outside diameter of the propellant member 70. The diameter of the longitudinal opening 72 fixes the position of the inner face of the propellant member 70 and the outside diameter of the propellant member 70 fixes the position of the outer face of the propellant member 70. The inner and outer faces of the propellant member 70 correspondingly define a propellant annular volume 78, which represents the amount of propellant in the propellant member 70. The propellant member 70 is constructed with a decreased diameter of the longitudinal opening 72 and/or an increased outside diameter of the propellant member 70 for a given length if the practitioner desires to increase the amount of propellant in the propellant member 70. Conversely, the propellant member 70 is constructed with an increased diameter of the longitudinal opening 72 and/or a decreased outside diameter of the propellant member 70 for a given length if the practitioner desires to decrease the amount of propellant in the propellant member 70.

The length of the propellant member 70 is typically on the order of up to about 2 feet or more and the transverse cross sectional diameter of the propellant member 70 is typically on the order of up to about 2 inches or more. Exemplary dimensions of the propellant member 70 are a length of about 2 feet, an outside diameter of about 2.25 inches, and a longitudinal opening diameter of about 0.4375 inches. Although the length of the propellant member 70 can be substantially equal to the length of the carrier 34 and/or isolation member 42, it is apparent that the length of the propellant member 70 can alternatively be substantially less than the length of the carrier 34 or the isolation member 42. In such cases, it is within the scope of the present invention to position a plurality of propellant members 70 within the carrier annular volume 44. In particular, the propellant members 70 are retained in series on the isolation member 42 in the manner recited above.

The propellant members 70 may be stacked end to end in series along the length of the isolation member 42 until the number of stacked propellant members 70 is sufficient to occupy substantially the entire length of the isolation member 42 within the carrier annular volume 44 with propellant members 70. In this case, the outer face of the isolation member 42 within the carrier annular volume 44 is fully covered by propellant members 70. Alternatively, a smaller number of propellant members 70 or the same number of propellant members 70, but each having a shorter length, may be placed in series on the isolation member 42, wherein the number of propellant members 70 is less than required to occupy substantially the entire length of the carrier annular volume 44. In this case, there are spaces on the outer face of the isolation member 42 within the carrier annular volume 44 which are not covered by a propellant member 70. If desired, the propellant members 70 can be secured by any suitable means at specific locations on the isolation member 42 (for example, in alignment with an aperture 60 on the carrier 34) to prevent slidable displacement of the propellant members 70 relative to the carrier 34 during operation of the stimulation module 30.

The propellant members 70 shown in FIGS. 2 and 3 and described above as being preferably generally tubular in configuration are termed herein "propellant sticks." The propellant member(s) may have suitable configurations other than the propellant stick configuration within the scope of the present invention. For example, the propellant member(s) may be configured as a spiral, linear or curved strip, or generally annular ring. When employing generally less preferred alternate configurations of the propellant member(s), it may be necessary to secure the alternately configured propellant member(s) to the outer face of the isolation member 42 by molding the propellant material thereon or by any other suitable means. As with the preferred tubular configuration, one or more alternately configured propellant members may extend along the entire length of the outer face of the isolation member 42 within the carrier annular volume 44 or may extend along only a portion thereof. In addition, one or more alternately configured propellant members may extend about the entire circumference of the outer face of the isolation member 42 within the carrier annular volume 44 or only about a portion thereof. Regardless of the propellant member configuration, the propellant members are preferably positioned on the isolation member 42 so that at least a portion of at least one aperture 60 of the carrier 34 is aligned with a propellant member 70.

Each propellant member 70 is preferably fabricated from a water repellent or water proof propellant material which is not physically affected by hydrostatic pressures commonly observed in the well bore 10 during completion or production operations. The propellant material is preferably unreactive or inert to almost all fluids and, in particular, to those fluids commonly encountered in the well bore 10. A preferred propellant material is a cured epoxy or plastic having an oxidizer incorporated therein, such as those commercially available from HTH Technical Services, Inc. of Coeur d'Alene, Id. and Owen Oil Tools, Inc. of Fort Worth, Tex. Such a propellant material requires two independent conditions for ignition. The propellant material must be subjected to a relatively high pressure, for example, at least about 500 psi, and an ignition propagator must be fired. The propellant member 70 is preferably fabricated by pouring or injecting the epoxy or plastic propellant material having an oxidizer incorporated therein into a mold (not shown) and allowed to cure in the mold at ambient or elevated temperature until the propellant material solidifies in the shape of the mold.

As recited above, the upper end 48 of the carrier 34 is threadably connected to the lower end 53 of the upper connector member 36 and the lower end 48 of the carrier 34 is threadably connected to the upper end 56 of the first lower connector member 38. The upper connector member 36 is also provided with female screw threads 80 on its upper end 82 and the first lower connector member 38 is provided with lower male screw threads 84 on its lower end 86. The second lower connector member 40 is provided with female screw threads 88 on its upper end 90 and male screw threads 92 on its lower end 94. The female screw threads 88 of the second lower connector member 40 cooperatively couple with the lower male screw threads 84 of the first lower connector member 38 to provide threadable connection of the upper end 90 of the second lower connector member 40 with the lower end 86 of the first lower connector member 38. O-rings 58 are also positioned at the intersection of the first and second lower connector members 38, 40 to provide a fluid-tight seal therebetween. As a result, the first lower connector member 38 is serially positioned between the carrier 34 and the second lower connector member 40.

The upper connector member 36, first lower connector member 38, and second lower connector member 40 are all preferably fabricated from substantially the same or similar reusable material as the carrier 34 and each member 36, 38, 40 preferably has a substantially tubular or open-ended hollow cylindrical configuration. The upper connector member 36 has a longitudinal opening 96 preferably concentric with the central longitudinal axis of the upper connector member 36 and extending the entire length of the axis. The upper connector member 36 preferably fully encloses the longitudinal opening 96 along its entire length. However, the longitudinal opening 96 has upper and lower segments 98, 100 at the upper and lower ends 82, 53, respectively, of the upper connector member 36, which are open and which have an expanded diameter relative to an intermediate segment 102 of the longitudinal opening 96. An upper booster fitting 104, having a tubular configuration with a longitudinal opening 106, is threadably or otherwise retained in the expanded upper segment 98 of the longitudinal opening 96.

An upper seal retention insert 108, likewise having a tubular configuration with a longitudinal opening 110, which includes a sealing seat, is threadably retained in the expanded lower segment 100 of the longitudinal opening 96. O-rings 58 are positioned at the intersection of the upper seal retention insert 108 and the upper connector member 36 to provide a fluid-tight seal therebetween.

An upper sealing assembly 112 having a longitudinal opening 114 is seated in and threadably retained within the longitudinal opening 110 of the upper seal retention insert 108 at the lower end 116 thereof. The upper sealing assembly 112 is preferably a conventional fluid-tight face seal fitting, such as those commercially available from Swagelock Company of Solon, Ohio. The upper seal retention insert 108 and upper sealing assembly 112 are preferably fabricated from the substantially the same or similar reusable material as the carrier 34, while the upper booster fitting 104 may be fabricated from a frangible or otherwise expendable plastic.

The first lower connector member 38 has a longitudinal opening 118 similar to the upper connector member 36. The longitudinal opening 118 extends the length of its central longitudinal axis and has expanded upper and lower segments 120, 122 and an intermediate segment 124. A lower seal retention insert 126 substantially identical to the upper seal retention insert 108, having a longitudinal opening 128 which includes a sealing seat, is threadably retained in the expanded lower segment 122 of the longitudinal opening 118. A lower sealing assembly 130 substantially identical to the upper sealing assembly 112 has a longitudinal opening 132 and is seated in and threadably retained within the longitudinal opening 128 of the lower seal retention insert 126 at the lower end 134 thereof. The second lower connector member 40 has a longitudinal opening 136 extending the length of its central longitudinal axis, which has expanded upper and lower segments 138, 140 and an intermediate segment 142. A lower booster fitting 144 substantially identical to the upper booster fitting 104 has a longitudinal opening 146 and is threadably or otherwise retained in the expanded lower segment 140 of the longitudinal opening 136.

The interconnected upper connector member 36, first lower connector member 38, second lower connector member 40 and carrier 34 cooperate with one another to maintain the desired position of the isolation member 42 (and correspondingly the associated detonator cord segment 68 and propellant members 70) within the carrier 34. In particular, the isolation member 42 is serially positioned (in descending order) within the longitudinal opening 110 of the upper seal retention insert 108, the longitudinal opening 114 of the upper sealing assembly 112, the longitudinal opening(s) 72 of the propellant member(s) 70, the longitudinal opening 118 of the first lower connector member 38, the longitudinal opening 128 of the lower seal retention insert 126, and the longitudinal opening 132 of the lower sealing assembly 130. The upper and lower sealing assemblies 112, 130 are tightened onto the isolation member 42 and the upper and lower seal retention inserts 108, 126, respectively, to fixably maintain the above-recited position of the isolation member 42 and to provide a fluid-tight seal between the carrier annular volume 44 and the longitudinal openings 96, 136 of the upper and second lower connector members 36, 40, respectively.

The detonator cord segment 68 extends the entire length of the isolation member interior 62 which maintains the detonator cord segment 68 in fluid isolation from the surrounding environment 46. An upper end 148 of the detonator cord segment 68 extends upwardly past the upper end 64 of the isolation member 42 through the longitudinal opening 96 of the upper connector member 36 and into the longitudinal opening 106 of the upper booster fitting 104 where the detonator cord segment 68 is no longer enclosed by the isolation member 42. An upper booster transfer 150, which is an additional component of the ignition propagator preferably containing a higher grade explosive than the detonator cord segment 68, is positioned in the longitudinal opening 106 of the upper booster fitting 104 and is engaged by the upper end 148 of the detonator cord segment 68. The upper sealing assembly 112 prevents fluid intrusion into the longitudinal openings 96, 106 and maintains the detonator cord segment 68, upper booster fitting 104 and their junction substantially free from fluid contact and dry therein.

A lower end 152 of the detonator cord segment 68 extends downwardly past the lower end 66 of the isolation member 42 through the longitudinal opening 136 of the second lower connector member 40 and into the longitudinal opening 146 of the lower booster fitting 144 where the detonator cord segment 68 is likewise no longer enclosed by the isolation member 42. A lower booster transfer 154 substantially identical to the upper booster transfer 150, which is likewise an additional component of the ignition propagator, is positioned in the longitudinal opening 146 of the lower booster fitting 144 and is engaged by the lower end 152 of the detonator cord segment 68. The lower sealing assembly 130 prevents fluid intrusion into the longitudinal openings 136, 146 and maintains the detonator cord segment 68, lower booster fitting 104 and their junction substantially free from fluid contact and dry therein.

It is apparent that additional stimulation modules, which are preferably substantially identical to the stimulation module 30 described above, can be threadably coupled with either end 82 or 94 of the stimulation module 30 to provide the stimulation tool of FIG. 1 having a plurality of stimulation modules 30 connected in series. In particular, the female screw threads 80 on the upper end 82 of the stimulation module 30 are coupled with the male screw threads 92 on the lower end 94 of an adjoining stimulation module 30. O-rings 58 are positioned at the intersection of the upper connector member 36 of the stimulation module 30 and the second lower connector member 40 of the adjoining stimulation module 30 to provide a fluid-tight seal therebetween and prevent fluid intrusion into the longitudinal openings 96, 106, 136, 146. When threadable end to end connection of two stimulation modules 30 is completed, the lower booster transfer 154 of the upper stimulation module (e.g., stimulation module 30*a* of FIG. 1) preferably engages the upper booster transfer 150 of the lower stimulation module (e.g., stimulation module 30*b* of FIG. 2).

If the stimulation module 30 is the only module of the stimulation tool or the stimulation module 30 is positioned at the lower terminus of a plurality of serially connected stimulation modules 30, the lower end 94 of the stimulation module 30 is simply sealed with the threaded fluid-tight cap 32 shown in FIG. 1 or connected in a fluid-tight manner to another down hole tool or other down hole device (not shown). If the stimulation module 30 is the only module of the stimulation tool or the stimulation module 30 is positioned at the upper terminus of a plurality of serially connected stimulation modules 30, the upper end 82 of the stimulation module 30 is simply connected in a fluid-tight manner to another down hole tool such as the adaptor sub 28 shown in FIG. 1.

Figure 4:
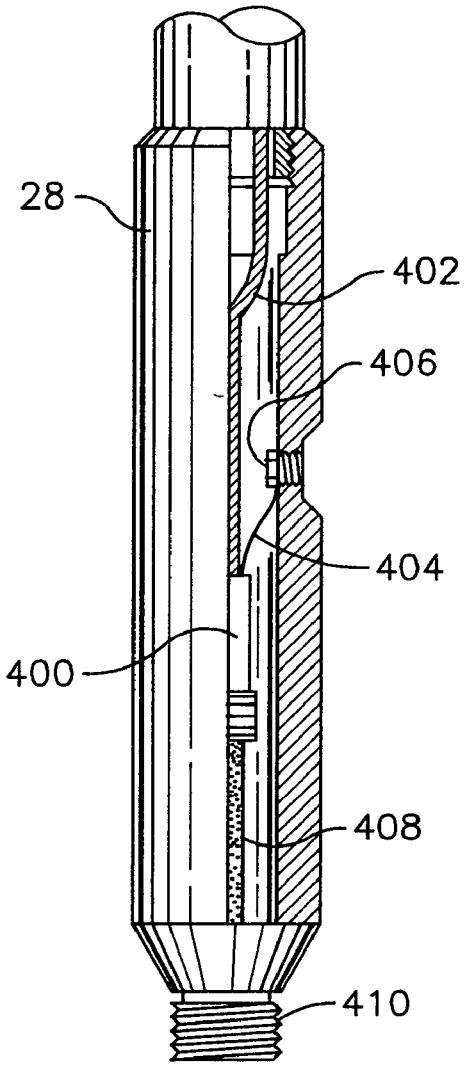
FIG. 4 is a partially cutaway longitudinal cross sectional view of an adaptor sub housing a starter assembly having utility in the stimulation tool of FIG. 1.

In addition to one or more stimulation modules 30, the stimulation tool of the present invention preferably further comprises a starter assembly for initiating ignition of the ignition propagator, i.e., the detonator cord segment 68 and booster transfers 150, 154, positioned in each stimulation module 30. The starter assembly and ignition propagator, in combination, are termed an ignition system herein. Referring to FIG. 4, an exemplary starter assembly is shown and described hereafter, which is not to be construed as limiting the scope of the invention. The starter assembly of the present example, is an electrical detonator 400 housed within the adaptor sub 28 shown in FIG. 1. An electrical cable 402 has two ends one of which (not shown) is connected to the cable head 24 (also shown in FIG. 1). The other end of the electrical cable 402 is connected to the electrical detonator 400. The detonator 400 is grounded to the metal adaptor sub 28 by a ground wire 404, which is attached to the adaptor sub 28 by any suitable means, such as a screw 406. A starter detonator cord segment 408 is secured to the detonator 400 and extends into the adjoining stimulation module 30 shown in FIGS. 1 and 2 where the starter detonator cord segment 408 engages the upper booster transfer 150 of the ignition propagator. The female screw threads 80 at the upper end 82 of the adjoining stimulation module 30 are threadably coupled in a fluid-tight manner with male screw threads 410 of the adapter sub 28.

In accordance with an alternate embodiment, the present invention is a method for operating the above-described stimulation tool. Referring to FIGS. 1 and 4, the stimulation tool is operable once it is appropriately positioned in the well bore 10. Operation is initiated by passing an electric current from a suitable current source at the surface 12 via the wireline 22 and electrical cable 402 to ignite the detonator 400. The detonator 400 in turn ignites the starter detonator cord segment 408 in the adaptor sub 28 and the booster transfers 150, 154 and detonator cord segment 68 in the adjoining stimulation module 30. The temperature and pressure resulting from ignition of the detonator cord segment 68 enclosed within the isolation member 42 of the adjoining stimulation module 30 readily disintegrates the isolation member 42 and ignites one or more propellant members 70 in the module 30 adjacent the isolation member 42. Each ignited propellant member 70 burns at a controlled burn rate.

The pressurized gas generated by burning each propellant member 70 exits the aperture(s) 60 of the carrier 34 and enters the subterranean formation 16 via the perforations formed in the casing 18, thereby clearing the perforations of any residual debris. The pressure of the propellant gases also stimulates the formation 16 by extending the connectivity of the formation 16 with the well bore 10, in particular, by fracturing the formation 16. The stimulation module 70 is usually not damaged to any significant extent during operation. Accordingly, the stimulation module 70 may be removed from the well bore 10 via the wireline 22, refurbished if necessary, and reused.

Figure 5:
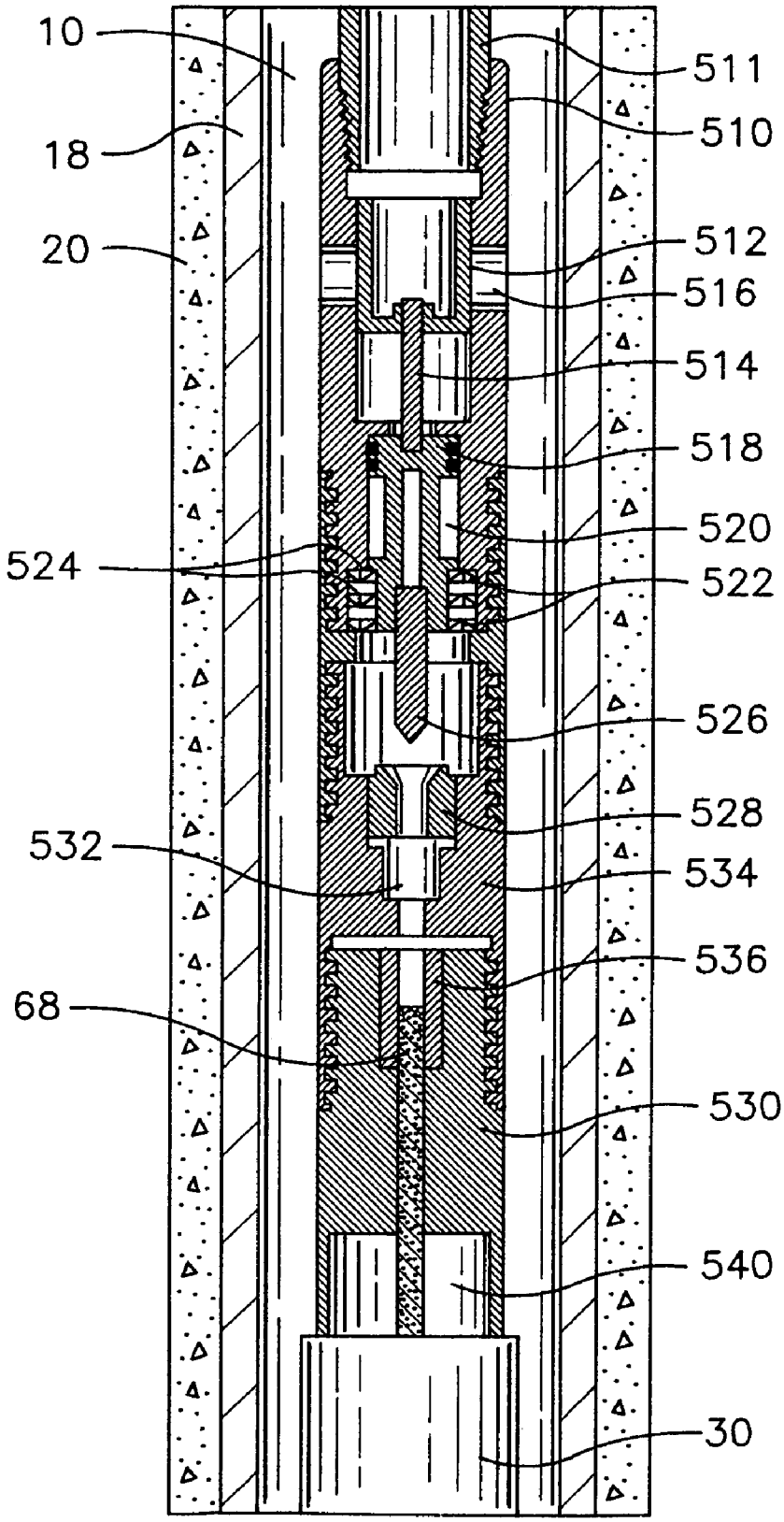
FIG. 5 is a partially cutaway longitudinal cross sectional view of an alternate starter assembly having utility in the stimulation tool of the present invention.

A percussion detonator may be employed as an alternate starter assembly in the above-disclosed ignition system. A percussion detonator is preferred for use in the present stimulation tool where the tool is run into a well bore on a tubular, such as a conventional tubing string or coil tubing. Referring to FIG. 5, an alternate starter assembly having a percussion detonator is shown which includes a vent housing 510 capable of attachment to the end of a tubing string 511 or wireline (not shown). A vent 512 is attached to a connecting rod 514 inside the vent housing 510 and seals a fluid passageway 516. The connecting rod 514 is in contact with a piston 518. An annular chamber 520 between the piston 518 and the interior wall of the vent housing 510 is filled with air at atmospheric pressure. Adjacent the bottom of the piston 518, shear pins 522 are mounted in a shear set 524, and a firing pin 526 extends downward from the bottom of the piston 518. A retainer 528 joins the vent housing 510 and a tandem sub 530. A percussion detonator 532 is mounted in a firing head 534 with the retainer 528, which is attached to the vent housing 510 and is capable of attachment to the tandem sub 530. The tandem sub 530 is attached to a stimulation module 60. An ignition transfer 536 at the top of tandem sub 530 is in contact with a starter detonator cord segment 538 passing through a central channel 540 and into the stimulation module 30 as described above.

Upon application of sufficient hydraulic pressure to the top of the piston 518, the vent 512 and piston 518 simultaneously move downward, opening the fluid passageway 516 and causing the firing pin 526 to contact the percussion detonator 532. Ignition of the percussion detonator 532 causes a secondary detonation in the ignition transfer 536, which in turn ignites the starter detonator cord segment 538. The starter detonator cord segment 538 runs into the adjacent stimulation module 30 and ignites the booster transfers and detonator cord segment, correspondingly igniting the propellant member(s) 70 therein.

Although not shown, it is within the scope of the present invention to omit one or more booster transfers 150, 154 from the ignition propagator of the stimulation module(s) 30. Where a booster transfer 150 or 154 is omitted, the adjacent detonator cord segment 68, 408 or 538 is simply extended to occupy the void in the longitudinal opening 106 or 146 resulting from the absent booster transfer 150 or 154. Thus, for example, if the adjoining lower and upper booster transfers 154, 150 are removed from the junction of two serially connected stimulation modules (e.g., 30*a* and 30*b*), the detonator cord segment 68 of the upper stimulation module 30*a* is lengthened so that it extends continuously downward through the adjoining lower stimulation module 30*b* as well. The detonator cord segment 68 can be lengthened to substantially any degree so that it extends continuously through any number of stimulation modules 30 depending on the number of booster transfers omitted. Likewise, if the upper booster transfer 150 is removed from the stimulation module 30 where it is connected to a starter assembly, the starter detonator cord segment 408 or 538 of the starter assembly is lengthened so that it extends continuously downward through the adjoining stimulation module 30, replacing the detonator cord segment 68 of the stimulation module 30.

As is appreciated by the skilled artisan, applying the teaching herein, the burn rate of the propellant member(s) 70 is a function of a number of physical parameters of the present stimulation tool. For example, the burn rate of the propellant member(s) 70 is a function of the relative geometry of the isolation member 42 and propellant member(s) 70. Other parameters which impact the burn rate of the propellant member(s) 70 are the thickness, density and explosive load of the detonator cord segment 68, the material and wall thickness of the isolation member 42, and the diameter of the interior 62 of the isolation member 42. Accordingly, it is an aspect of the present invention to set the burn rate of the propellant member(s) 70 by appropriate selection of values for the above-recited propellant member, isolation member, and detonator cord segment parameters.

Conditions which favor disintegration of the isolation member 42 and correspondingly disintegration of the propellant member(s) 70 into relatively smaller fragments upon detonation of the ignition propagator generally favor a relatively faster burn rate of the propellant member(s) 70, while conditions which favor disintegration of the isolation member 42 and correspondingly disintegration of the propellant member(s) 70 into relatively larger pieces generally favor a relatively slower burn rate of the propellant member(s) 70. Thus, increasing the thickness, density and/or the explosive load of the detonator cord segment 68 increases the burn rate of the propellant member(s) 70. Increasing the diameter of the interior of the isolation member 42 likewise increases the burn rate of the propellant member(s) 70. Selecting a relatively high strength material for the isolation member 42 or increasing the wall thickness of the isolation member 42 decreases the burn rate of the propellant member(s) 70. Selecting the relative geometry of the isolation member 42 and propellant member(s) 70 such that close fitting engagement of the propellant member 70 with the isolation member 42 is achieved increases the burn rate of the propellant member(s) 70, while selecting the relative geometry of the isolation member 42 and propellant member(s) 70 such that loose fitting engagement of the propellant member 70 with the isolation member 42 is achieved decreases the burn rate of the propellant member(s) 70.

It is further within the purview of the skilled artisan applying the teaching herein to control the venting of the pressurized combustion gas from the carrier and correspondingly controlling the pressure at which the combustion gas enters the subterranean formation 16 by selection of the size of the aperture(s) 60, the number of apertures 60 and the pattern of apertures 60 on the carrier 34. Accordingly, it is an aspect of the present invention to set the venting rate of combustion gas from the stimulation tool by appropriate selection of values for the above-recited aperture parameters. In general, decreasing the size and/or number of apertures 60 decreases the gas venting rate and increases the pressure of the combustion gas exiting the carrier 34. The pattern of apertures 60 on the carrier 34 may be selected to either increase or decrease the gas venting rate depending on the particular pattern selected, as can be appreciated by the skilled artisan.

In accordance with another alternate embodiment, the present invention is a method for optimizing operation or otherwise defining operational performance of the above-described stimulation tool. In accordance with this embodiment, a value for one or more of the above-recited propellant member, isolation member, detonator cord segment and aperture parameters for the stimulation tool are selected by the practitioner, preferably using a computer employing specific modeling software. The values are preferably selected based on a prediction of the modeling software for achieving a desired outcome. A plurality of high speed gauges (not shown) for monitoring pressure or other process conditions are positioned at select locations within the well bore 10 and/or the stimulation tool. The stimulation tool is operated in the well bore 10 as described above in a first test run while collecting first test run data from the gauges, such as combustion gas pressure. The first test run data is analyzed to determine if a first actual outcome of the first test run matches or approximates the desired outcome. If not, or the practitioner otherwise wishes to achieve an outcome other than the first actual outcome, the practitioner modifies the value of the selected parameters for the stimulation tool and/or the predictive functions of the modeling software. A second test run is performed and the second test run data is analyzed to determine if a second actual outcome matches or approximates the desired outcome. Any number of test runs are performed, modifying the value of the selected parameters and/or the predictive functions of the modeling software, until the desired outcome is achieved.

Figure 6:
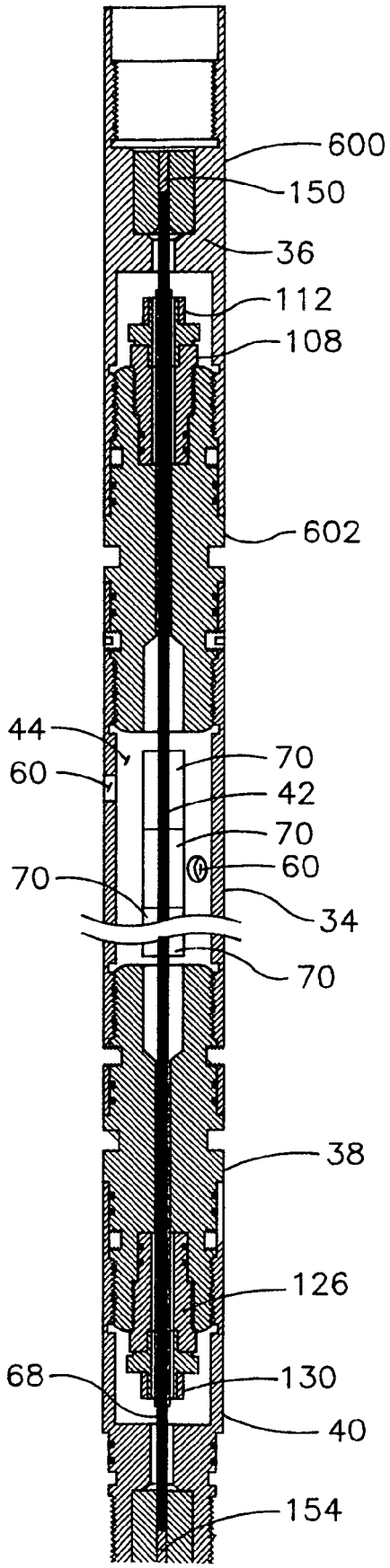
FIG. 6 is a longitudinal cross sectional view of an alternate embodiment of a stimulation module having utility in the stimulation tool of FIG. 1.

Referring to FIG. 6, details of an alternate stimulation module designated 600 are shown and described hereafter, which has utility in the stimulation tool of the present invention. Elements of the stimulation module 600 which are common to the stimulation module 30 described above are designated by the same reference characters. The stimulation module 600 is essentially the same as the stimulation module 30 except that a second upper connector member 602 is positioned in series between the upper connector member 36 and the carrier 34 of the stimulation module 600. This second upper connector member 602 is essentially identical to the first lower connector member 38 of both stimulation modules 600 and 30. Operation of the stimulation module 600 is essentially the same as the stimulation module 30.

As noted above, the present stimulation tool can be utilized with tubing or wireline. The increased strength of tubing over wireline provides certain advantages. For example, the use of tubing to convey the tool into a well bore permits the use of a longer stimulation modules and/or a greater number of stimulation modules secured together in series, thereby permitting a longer interval to be stimulated by a single trip into the well bore. Use of tubing is also compatible with the use of packers to isolate one or more portions of the well bore adjacent one or more intervals of the formation. The present tool may be used where it is desired to limit the pressure in another portion of the well bore, for example, where one or more zones in a well bore have already been completed. Further, if the well bore has a high deviation angle from vertical or is horizontal, the tubing may be used to push the tool into the well bore.

Although the carrier 34 and other components of the stimulation tool are described above as preferably being fabricated from a high-integrity metal which is reusable, it is alternatively within the scope of the invention to fabricate the such components from a material which is not reusable (i.e., a material which substantially entirely breaks up or decomposes during normal operation, namely upon detonation of the propellant member(s) 70). Exemplary materials include polyester fibers, epoxy composites and the like.

While the forgoing preferred embodiments of the invention have been described and shown, it is understood that alternatives and modifications, such as those suggested and others, may be made thereto and fall within the scope of the invention.

We claim:

1. An apparatus for stimulating a subterranean formation comprising:

a first tube having a first tube interior, an open first end and a first tube wall with a length, wherein said first tube wall has at least one aperture along said length of said first tube wall;

a first connector member connected to said first end of said first tube and having a first connector interior;

a second tube positioned within said first tube interior, said second tube having a second tube interior, a second tube wall with a length, a first open end, and a second open end, wherein said second tube interior is sealed from said first tube interior to substantially prevent fluid communication between said first tube interior and said second tube interior;

a combustion body positioned within said first tube interior external to said second tube interior;

an ignition propagator positioned within said second tube interior, extending from said second tube interior through said first open end of said second tube substantially into said first connector interior, and substantially free from fluid contact with fluid residing in a surrounding environment external to said first tube wall; and a first sealing assembly engaging said second tube to substantially prevent fluid communication between said first tube interior and said first connector interior.

2. The apparatus of claim 1, wherein said aperture is an open aperture permitting fluid communication between said first tube interior and said surrounding environment external.

3. The apparatus of claim 1, wherein said first tube has an open second end, said apparatus further comprising a second connector member connected to said second end of said first tube and having a second connector interior, wherein said first tube is serially positioned between said first and second connector members.

4. The apparatus of claim 3, wherein said ignition propagator extends from said first tube interior into said second connector interior.

5. The apparatus of claim 3 further comprising a second sealing assembly engaging said second tube to substantially prevent fluid communication between said first tube interior and said second connector interior.

6. The apparatus of claim 3 further comprising a third connector member having a third connector interior, wherein said third connector member connects said second connector member to said second end of said first tube and said third connector member is serially positioned between said first tube and said second connector member, and further wherein said second tube is positioned in said third connector interior.

7. The apparatus of claim 1, wherein said first tube has an open second end, said apparatus further comprising a second connector member connected to said first end of said first tube, said second connector member serially positioned between said first tube and said first connector member, and a third connector member and a fourth connector member connected to said second end of said first tube, said third connector member serially positioned between said first tube and said fourth connector member, wherein said second connector member has a second connector interior, said third connector member has a third connector interior, and said fourth connector member has a fourth connector interior.

8. The apparatus of claim 7, wherein said ignition propagator extends from said first tube interior into said first, second, third and fourth connector interiors.

9. The apparatus of claim 7, further comprising a second sealing assembly engaging said second tube to substantially prevent fluid communication between said first tube interior and said fourth connector interior.

10. The apparatus of claim 9, wherein said ignition propagator extends from said second tube interior into said first and fourth connector interiors.

11. The apparatus of claim 1, wherein said first tube is fabricated from a material and in a configuration such that said first tube does not substantially decompose or disintegrate during burning of said combustion body.

12. The apparatus of claim 1, wherein said second tube is fabricated from a material and in a configuration such that said second tube substantially decomposes or disintegrates upon ignition of said ignition propagator.

13. The apparatus of claim 1, wherein said combustion body is a propellant member.

14. The apparatus of claim 1, wherein said ignition propagator includes a detonator cord.

15. The apparatus of claim 1, wherein said ignition propagator includes a booster transfer.

16. The apparatus of claim 1 further comprising a starter assembly connected to said ignition propagator and a fluid sealed junction between said starter assembly and said ignition propagator.

17. An apparatus for stimulating a subterranean formation comprising:

a first tube having a first tube interior, an open first end and a first tube wall, said first tube wall having an inner face, an outer face and a length, wherein said first tube wall has at least one aperture along said length of said first tube wall;

a connector member connected to said first end of said first tube and having a connector interior;

a second tube positioned within said first tube interior and having an open end, a second tube interior and a second tube wall, said second tube wall having an inner face, an outer face and a length, wherein said outer face of said second tube wall and said inner face of said first tube wall define an annular volume;

a propellant member having a longitudinal opening and a member wall, said member wall having an inner face, an outer face and a length, said propellant member positioned in said first tube interior and said longitudinal opening receiving said second tube, wherein said propellant member does not substantially extend beyond said annular volume;

an ignition propagator positioned within said second tube interior, extending from said second tube interior through said open end of said second tube substantially into said connector interior, and substantially free from fluid contact with fluid residing in a surrounding environment external to said first tube wall; and a first sealing assembly engaging said second tube to substantially prevent fluid communication between said first tube interior and said connector interior.

18. The apparatus of claim 17 further comprising a void between said outer face of said member wall and said inner face of said first tube wall.

19. The apparatus of claim 17, wherein said longitudinal opening slidably receives said second tube.

20. The apparatus of claim 17, wherein said length of said member wall of said propellant member is substantially less than said length of said second tube wall.

21. The apparatus of claim 17, wherein said propellant member is a first propellant member, said apparatus further comprising a second propellant member having a longitudinal opening and a member wall, said member wall of said second propellant member having an inner face, an outer face and a length, said second propellant member positioned in said first tube interior and said longitudinal opening of said second propellant member receiving said second tube such that said second propellant member is mounted on said second tube substantially adjacent said first propellant member.

22. The apparatus of claim 21, wherein said length of said member wall of said first propellant member is substantially equal to said length of said member wall of said second propellant member.

23. The apparatus of claim 21 further comprising a void between said outer face of said member wall of said second propellant member and said inner face of said first tube wall.

24. The apparatus of claim 21, wherein said longitudinal opening of said second propellant member slidably receives said second tube.

25. The apparatus of claim 21 comprising a third propellant member having a longitudinal opening and a member wall, said member wall of said third propellant member having an inner face, an outer face and a length, said third propellant member positioned in said first tube interior and said longitudinal opening of said third propellant member receiving said second tube such that said third propellant member is mounted on said second tube substantially adjacent said first or second propellant member.

26. The apparatus of claim 21, wherein said second tube interior is sealed from said first tube interior to substantially prevent fluid communication between said first tube interior and said second tube interior and said ignition propagator positioned within said second tube interior is substantially free from fluid contact with fluid residing in a surrounding environment external to said first tube wall.

27. A method for defining the operational performance of a stimulation apparatus comprising:

selecting a first value of one or more parameters of a stimulation apparatus comprising, a first tube having a first tube interior and a first tube wall with a length, wherein said first tube wall has a plurality of apertures along said length of said first tube wall, a second tube positioned within said first tube interior, said second tube having a second tube interior and a second tube wall with a length, a combustion body positioned within said first tube interior external to said second tube interior, and an ignition propagator positioned within said second tube interior, wherein said one or more parameters are selected from a group consisting of relative geometry of said second tube and said combustion body, thickness of said ignition propagator, density of said ignition propagator, explosive load of said ignition propagator, material composition of said second tube and thickness of said second tube wall, diameter of said second tube interior, size of said apertures, number of said apertures, and pattern of said apertures along said length of said first tube wall;

positioning a plurality of process condition monitors in a well bore;

positioning said stimulation apparatus within said well bore;

performing a first test run of said stimulation apparatus, wherein said first test run comprises igniting said combustion body with said ignition propagator and burning said ignited combustion body, thereby forming a combustion gas;

obtaining first test run data relating to said combustion gas using said process condition monitors;

modifying said first value of said one or more parameters to a second value of said one or more parameters in response to said first test run data;

performing a second test run of said stimulation apparatus, wherein said second test run is substantially the same as said first test run; and obtaining second test run data relating to said combustion gas using said process condition monitors.

28. The method of claim 27 further comprising fixing said second value of said one or more parameters or modifying said second value of said one or more parameters to a third value of said one or more parameters in response to said second test run data.

29. The method of claim 27, wherein said first test run data is pressure data.

30. An apparatus for stimulating a subterranean formation comprising:

a first stimulation module including, a first tube having a first tube interior and a first tube wall with a length, wherein said first tube wall has at least one aperture along said length of said first tube wall, a first connector member connected to said first tube and having a first connector interior, a second connector member connected to said first tube and having a second connector interior, a second tube positioned within said first tube interior, said second tube having a second tube interior, a second tube wall with a length, a first open end, and a second open end, wherein said second tube interior is sealed from said first tube interior to substantially prevent fluid communication between said first tube interior and said second tube interior, a combustion body positioned within said first tube interior external to said second tube interior, and an ignition propagator positioned within said second tube interior and having a first segment extending from said second tube interior through said first open end of said second tube substantially into said first connector interior and having a second segment extending from said second tube interior through said second open end of said second tube substantially into said second connector interior, wherein said first and segments of said ignition propagator are substantially free from fluid contact with fluid residing in a surrounding environment external to said first tube wall, a first sealing assembly engaging said second tube to substantially prevent fluid communication between said first tube interior and said first connector interior, and a second sealing assembly engaging said second tube to substantially prevent fluid communication between said first tube interior and said second connector interior; and a second stimulation module including, a first tube having a first tube interior and a first tube wall with a length, wherein said first tube wall has at least one aperture along said length of said first tube wall, a first connector member connected to said first tube and having a first connector interior, a second connector member connected to said first tube and having a second connector interior, a second tube positioned within said first tube interior, said second tube having a second tube interior, a second tube wall with a length, a first open end, and a second open end, wherein said second tube interior is sealed from said first tube interior to substantially prevent fluid communication between said first tube interior and said second tube interior, a combustion body positioned within said first tube interior external to said second tube interior, and an ignition propagator positioned within said second tube interior and having a first segment extending from said second tube interior through said first open end of said second tube substantially into said first connector interior and having a second segment extending from said second tube interior through said second open end of said second tube substantially into said second connector interior, wherein said first and segments of said ignition propagator are substantially free from fluid contact with fluid residing in a surrounding environment external to said first tube wall, a first sealing assembly engaging said second tube to substantially prevent fluid communication between said first tube interior and said first connector interior, and a second sealing assembly engaging said second tube to substantially prevent fluid communication between said first tube interior and said second connector interior;

wherein said second connector of said first stimulation module is coupled with said first connector of said second stimulation module such that said second connector interior of said first stimulation module and said first connector interior of said second stimulation module define a joint chamber wherein said second segment of said ignition propagator of said first stimulation module engages said first segment of said ignition propagator of said second stimulation module.

31. The apparatus of claim 30, wherein said ignition propagators of said first and second stimulation modules each includes a detonator cord.

32. The apparatus of claim 30, wherein said ignition propagators of said first and second stimulation modules each includes a booster transfer.

33. The apparatus of claim 30, wherein said second segment of said ignition propagator of said first stimulation module and said first segment of said ignition propagator of said second stimulation module are a single continuous length of detonator cord.

34. The apparatus of claim 30, wherein said second segment of said ignition propagator of said first stimulation module includes a booster transfer and said first segment of said ignition propagator of said second stimulation module includes a booster transfer and wherein said booster transfer of said second segment of said ignition propagator of said first stimulation module engages said booster transfer of said first segment of said ignition propagator of said second stimulation module.

* * * * *